US007857420B2

(12) United States Patent
Reid

(10) Patent No.: US 7,857,420 B2
(45) Date of Patent: Dec. 28, 2010

(54) METHODS AND APPARATUS TO IDENTIFY PAGES TO BE DISCARDED IN A PRINT SYSTEM

(75) Inventor: Christopher P. Reid, Erie, CO (US)

(73) Assignee: Infoprint Solutions Company, LLC, Boulder, CO (US)

( * ) Notice: Subject to any disclaimer, the term of this patent is extended or adjusted under 35 U.S.C. 154(b) by 371 days.

(21) Appl. No.: 11/965,558

(22) Filed: Dec. 27, 2007

(65) Prior Publication Data

US 2009/0165663 A1 Jul. 2, 2009

(51) Int. Cl.
*B41J 2/165* (2006.01)

(52) U.S. Cl. ..... 347/35

(58) Field of Classification Search ..... None
See application file for complete search history.

(56) References Cited

U.S. PATENT DOCUMENTS 5,659,342 A * 8/1997 Lund et al. ..... 347/35
6,075,617 A 6/2000 Fischer et al.
6,199,178 B1 3/2001 Schneider et al.
6,421,138 B1 7/2002 McIntyre
6,793,310 B2 * 9/2004 Darby et al. ..... 347/16
2005/0195249 A1 * 9/2005 Nakamura et al. ..... 347/71

FOREIGN PATENT DOCUMENTS

JP 10268391 A 10/1998

OTHER PUBLICATIONS

Grimm, Robert, et al.; *System Support for Pervasive Applications*; ACM Transactions on Computer Systems; Nov. 2005; vol. 22 No. 4; pp. 421-486.

* cited by examiner

*Primary Examiner*—Matthew Luu
*Assistant Examiner*—Alejandro Valencia
(74) *Attorney, Agent, or Firm*—Duft Bornsen & Fishman, LLP

(57) ABSTRACT

Methods and apparatus for adding pages to a sequence of imprinted images used for flushing of inkjet features and then discarding the added pages following imprinting of the added pages. Features and aspects hereof within a printing system automatically insert additional pages (flush pages) in a sequence of imprinted page. The inserted pages are used for flushing ink-based nozzles (e.g., inkjet nozzles). The frequency of flushes and the volume of ink to be flush at each opportunity may be determined by automated features hereof based on statistics regarding operation of the printing system or may be statically pre-determined. Post-processing features (e.g., paper handling features) may scan the pages for marks identifying a page as a flush page inserted for flushing and may discard the added pages so identified.

21 Claims, 6 Drawing Sheets

METHODS AND APPARATUS TO IDENTIFY PAGES TO BE DISCARDED IN A PRINT SYSTEM

BACKGROUND

1. Field of the Invention

The invention relates generally to methods and apparatus in a printing environment to identify pages for discarding in the printing environment where the identified pages are used exclusively to flush inkjet features of the printing system. More specifically, the invention relates to methods and apparatus for marking a page as a test or flush page to be discarded from a sequence of pages generated by a printing environment.

2. Discussion of Related Art

In ink-based printing system (e.g., inkjet and other ink deposition systems) it is often necessary to clean clogged ink deposition nozzles. As the printing system is producing imprinted images on paper (or other printable media), the frequency and volume of ink usage for each of multiple ink colors may vary. Some ink nozzles for some ink colors may be heavily used over a sequence of printed sheets/images while other nozzles associated with other ink colors may be infrequently used or not used at all. These nozzles with limited use may clog if not maintained by a cleaning procedure.

It is generally known to stop the printing process to permit manual intervention to clear all nozzles of an ink-based printing system. The manual intervention may entail purely manual procedures such as actuating a cleaning request option on the operator panel of the printing system. Or, such manual procedures may entail formatting and printing a page/image that intentionally utilizes all ink nozzles or selected ink nozzles to keep the nozzles clean (by flowing a sufficient volume of ink there through). Such manual intervention gives rise to a need for human intervention to clean the nozzles if not also to format a suitable cleaning page/image and to forward the formatted image to the marking engine of the printing system. This manual intervention can cause a significant delay in the continued processing of the printing system. In high-volume production printing environments, such a delay can be very costly.

It is therefore generally known to provide some automated procedure to flush nozzles of an ink-based printing system without requiring manual intervention and thus without stopping the operation of the printing system to await human intervention. In some known automated techniques, so called "flush lines" are added to an imprinted image while the printing system continues its production printing process. Flush lines are simply rendered graphical images intended merely to cause ink to flow through all (or selected ones) of the nozzles of the ink-based printer. The graphical image so produced by flush lines is not generally intended to represent any information meaningful to a user. Preferably such flush lines are placed on the printable medium (e.g., paper) in an area that may be cut away (e.g., "chipped out") or may be simply embedded within the printed images preferably in an area that will not render the printed information unusable or unreadable.

However, in a large number of printing applications there may be no area of the page/sheetside image or of the printable medium in which such flush lines may be generated without rendering the intended printed images unusable. For example, the imprinted images may occupy the entire printable surface of the printable medium (e.g., "edge to edge" printing) and/or the imprinted images may simply be of a nature that the flush lines, if integrated within the printable area, would render the printed images unusable for their intended purpose.

It is evident from the above discussion that an ongoing need exists for improved methods and apparatus for performing automated flush procedures for ink-based printing systems.

SUMMARY

The present invention solves the above and other problems, thereby advancing the state of the useful arts, by providing methods and apparatus for placing flush lines or patterns on additional pages (flush pages) in a sequence of printed images and for discarding the flush pages in post-processing following the imprinting of the flush lines or patterns. The flush pages may be marked so that automated components associated with the printing system may identify the flush pages and discard them from the normal sequence of processed page images.

One aspect hereof provides a method for managing ink flush operations in an ink-based printing environment. The method includes inserting a flush page in a sequence of printed pages and imprinting pixels on the flush page to flush ink through the marking engine print head. The method also includes marking the flush page with a machine readable identifier generated by the marking engine to identify the flush page. The method then includes detecting the machine readable identifier on an imprinted page after the marking engine has imprinted the imprinted page to determine that the imprinted page is a flush page. The flush page so detected is the removed from the sequence of printed pages responsive to the detection of the machine readable identifier. The method is performed by the printing environment without human intervention.

Another aspect hereof provides for a method operable in an inkjet printing system for flushing ink in the inkjet printing system. The method includes generating a flush page image including a flush pattern to flush ink through a marking engine of the inkjet printing system and printing the flush page image on a printable medium interspersed with a sequence of printed pages. The method also includes identifying the flush page image on the printable medium and removing from the sequence of pages a page of the printable medium including the flush page image.

DETAILED DESCRIPTION OF THE DRAWINGS

FIGS. 1 through 6 and the following description depict specific exemplary embodiments of the present invention to teach those skilled in the art how to make and use the invention. For the purpose of this teaching, some conventional aspects of the invention have been simplified or omitted. Those skilled in the art will appreciate variations from these embodiments that fall within the scope of the present invention. Those skilled in the art will appreciate that the features described below can be combined in various ways to form multiple variations of the present invention. As a result, the invention is not limited to the specific embodiments described below, but only by the claims and their equivalents.

Figure 1:
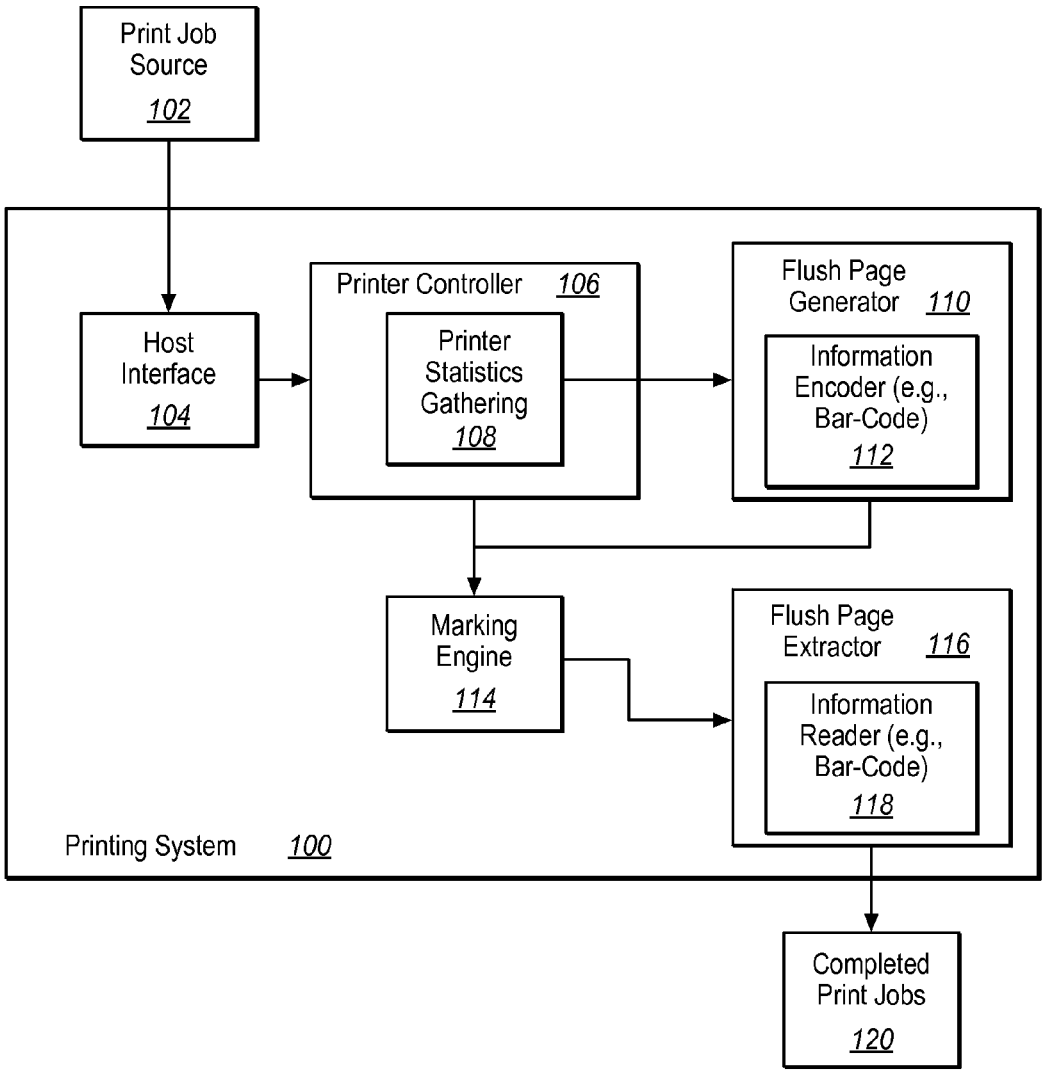
FIG. 1 is a block diagram of an exemplary printing system adapted to generate flush pages interspersed with other printed pages and to remove/extract the flush pages from the sequence of printed pages in accordance with features and aspects hereof

FIG. 1 is a block diagram of a printing system 100 enhanced in accordance with features and aspects hereof to insert additional pages ("flush pages") within a sequence of printed pages representing one or more print jobs. Printing system 100 may include a host interface 104 adapted to receive print jobs from a print job source 102 (such as a host system or other spooling/server systems). Data received from such a print job source is forwarded through host interface 104 to printer controller 106. Controller 106 is generally operable to control overall operation of printing system 100 and in particular is adapted to render sheetside images representing the requested print data. Printer controller 106 generates the sequence of printed pages representing the received print job data and forwards the rendered pages to marking engine 114 for imprinting on the printable medium (e.g., paper).

Flush page generator 110 prepares a flush page when it determines the need for flushing one or more colors of ink used by marking engine 114 (flushing ink through a corresponding nozzle to keep the nozzle clean). The flush page includes flush lines to assure a suitable volume of ink is flowed through each of the one or more color ink nozzles identified as requiring a flush.

Preferably, the flush page image may also include an identifier indicating that the page is such a flush page and not a printed page comprising a part of some print job. Such an identifier is preferably a symbol or graphic that is recognizable by automated machine vision—e.g., a machine-readable indicator/identifier. This identifier is imprinted on the flush page along with the flush lines. The identifier is then recognized by further elements discussed below to identify the page—after imprinting—as a flush page and not a printed page of some print job.

Printer controller 106 may include a printer statistics gathering element 108 that maintains various printing statistics regarding operation of the printing system 100. For example, such statistics may include pixel counters representing the pixels printed for each page as well as total pixels printed by the printing system. Further exemplary statistics may include pixels printed for each of multiple colors of ink utilized by marking engine 114. Still further other exemplary statistics may include total number of pages printed, pages printed since a previous flush operation, etc.

The printer statistics so gathered by element 108 may be utilized by flush page generator 110 to determine when it may be necessary to perform a flush on one or more colors of ink utilized by marking engine 114 in printing system 100. As noted above, as sequences of pages are printed, various colors of ink may be more or less utilized depending on the particular data imprinted on each page. Flush page generator 110 therefore analyzes statistics provided by a printer statistics gathering element 108 to determine which colors of ink need be flushed and when such a flush should be provided.

The flush page image so generated is forwarded to marking engine 114 to be inserted or interspersed with a sequence of printed pages provided by printer controller 106 representing one or more received print jobs. Thus, when flush page generator 110 determines that a flush operation is presently required for one or more ink nozzles of marking engine 114, a flush page is generated and inserted into the sequence of printed pages.

Such an inserted, additional, flush page must then be extracted, removed, or discarded from the sequence of printed pages generated by printer controller 106 as representing one or more received print jobs. As imprinted pages are completed by marking engine 114, flush page extractor 116 scans the imprinted page to determine if an imprinted page is such an additional, inserted, flush page. The scan may detect the presence of the identifier added to the flush page image to identify the imprinted page as a flush page. If no identifier is found in the scan of the page, the imprinted page is merely one of a sequence of printed pages representing a supplied print job rendered by a printer controller 106 for printing by marking engine 114. Such a normal printed page is ignored by flush page extractor 116 and normal post-processing, if any, is performed to add the imprinted page to the stack of completed print jobs 120. However, if the flush page extractor 116 scans an imprinted page, senses the presence of an identifier, and thus determines that the page is an added, inserted, flush page, flush page extractor 116 physically removes that identified flush page from the sequence of printed pages and appropriately discards, removes, or otherwise processes the flush page outside of the normal sequence of printed pages. For example, the flush page may be removed from the normal sequence of printed pages and re-routed to a different paper output tray (not shown) of the printing engine. Well known paper handling, post-processing devices may be used and suitably programmed to perform the features of flush page extractor 116.

Flush page extractor 116 scans each imprinted page as it exits the marking engine 114 to determine if the imprinted page is a flush page. Such scanning may be by any suitable means including, for example, optical scanning of information imprinted on the printable medium. Thus any useful symbol or machine readable indicia may be included in the flush page image by flush page generator 110 and imprinted on a flush page to serve as an identifier that the page represents an additional, inserted, flush page and should be extracted by operation of flush page extractor 116.

In one exemplary embodiment, bar code symbols may be added to the flush page image and imprinted on the flush page (in addition to the desired flush lines to ensure proper flushing of one or more ink nozzles). The bar code symbols may encode information useful to an operator such that the flush page, though extracted from the sequence of standard pages, may still be referred to by an operator to obtain information about the flush operation or about the printer system more generally. For example, the bar code information may include a flush sequence number or identifier, date and/or time, the volume of ink flushed for each nozzle selected for flushing, etc. Any useful statistical or status information regarding operation of the printing system may be provided in such bar coded symbols.

Whatever symbol is chosen as an identifier for the additional, inserted, flush page, it preferably is a symbol or sequence not normally found on pages of a standard sequence of pages in a print job. Thus, the identifier will uniquely identify the page as an additional, inserted, flush page. Where, for example, bar code information is encoded to provide the requisite identifier indicating that the page is an additional, inserted, flush page, and since bar coded information may be present in pages of a print job, the bar coded information used as the flush page identifier may also include some unique identifier guaranteed to be present only in such an additional, inserted, flush page.

Those of ordinary skill in the art will readily recognize that marking engine 114 may be a so called ink jet marking engine or any other ink based or in deposition marking apparatus. Thus the features and aspects hereof associated with ink flushing may be used in any appropriate ink deposition imaging system where nozzles may become clogged over time. Further, printing system 100 may imprint printable media (e.g., paper) utilizing cut sheet paper feeding techniques or continuous form paper feeding techniques. Regardless of the type of printable media, flush page extractor 116 is operable to extract the additional, inserted, flush page from the sequence of pages otherwise representing one or more received print jobs. Further yet, the particular integration or separation of modules shown in FIG. 1 is intended merely as exemplary. Certain functional modules shown as distinct in FIG. 1 may be integrated while others functional elements shown as integrated may be separated and distinct operational elements. For example, the flush page extractor may be a post-processing device with its own programmable processing capabilities physically distinct from (though coupled to) the printing system 100 and/or marking engine 114. Such design choices will be readily apparent to those of ordinary skill in the art. Still further, those of ordinary skill in the art will readily recognize numerous additional or equivalent elements in a fully functional printing system 100. Such additional and equivalent elements are omitted for simplicity and brevity of this discussion.

Figure 2:
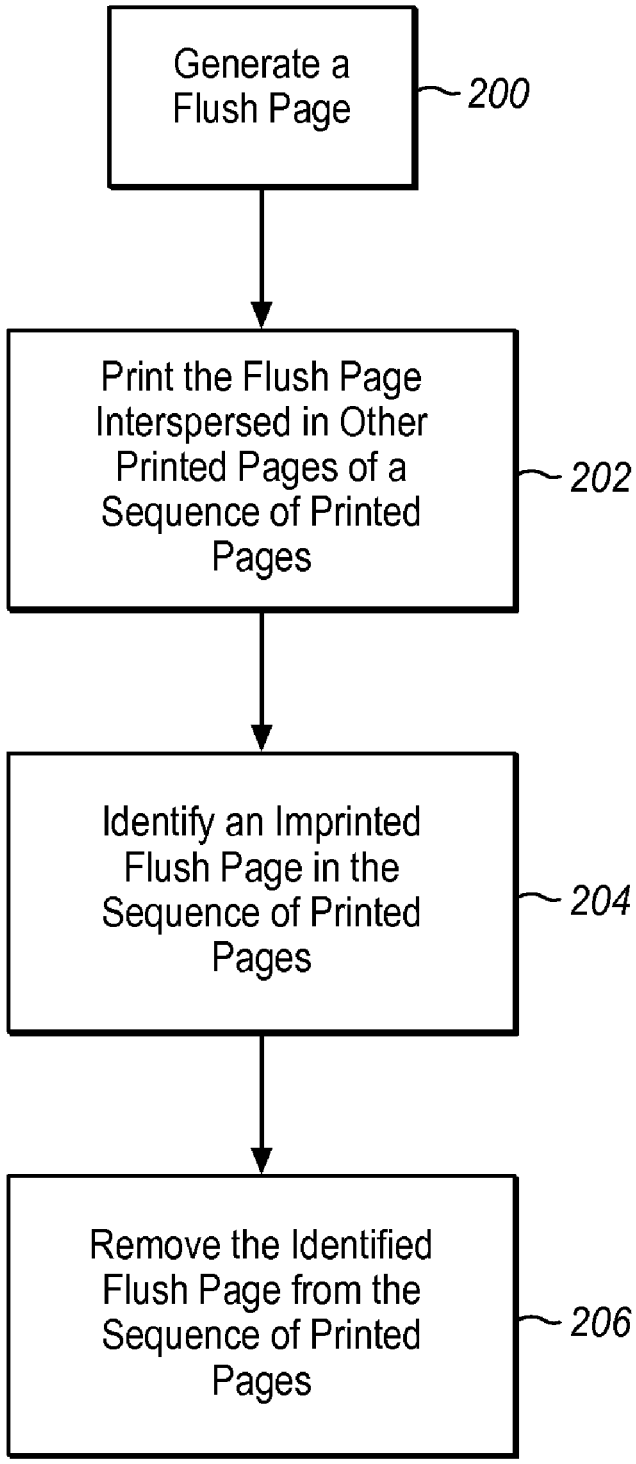
FIG. 2 is a flowchart describing an exemplary method to generate flush pages interspersed/inserted with other printed pages and thence removed from the sequence of printed pages in accordance with features and aspects hereof.

FIG. 2 is a flowchart describing overall operation of an exemplary method in accordance with features and aspects hereof. Step 200 represents processing within the printing system to generate a flush page. As noted above, such a decision to generate may be based upon statistical information gathered within the printing system. The flush page generated will include at least flush lines intended to flow an appropriate volume of ink through one or more selected nozzles that may require cleaning. Step 202 then imprints the flush page inserting it or interspersing it with other printed pages of a sequence of pages representing one or more print jobs. In general the flush page will be inserted as the next page to be imprinted by the marking engine to implement the desired flushing of ink through one or more selected ink nozzles.

In addition to the flush lines generated by step 200 on the flush page, the identifier noted above or other suitable indicia is included on the flush page image to allow the flush page to be later identified as such and thence separated from the normal sequence of the printed pages. Step 204 therefore represents processing within a printing system (e.g., often by a post-processing device that physically receives the imprinted images from the marking engine) to identify and imprinted flush page within the sequence of otherwise normal printed pages representing one or more print jobs. Having so identified such a flush page, step 206 removes (e.g., discards or redirects) the identified flush page from the sequence of printed pages otherwise representing one or more print jobs. This processing to identify the flush page and to remove it from a sequence of printed pages for a job is typically performed by a post-processing device capable of physically removing the flush page by diverting it or re-directing it out of the stack of completed printed pages for one or more print jobs. Such "post-processing" may be under control of the same controller that interacts with the host systems and the marking engine or may be controlled by a separate control unit that is communicatively coupled with other controllers of the printing system. Such design choices for integration or separation of these control functions are well known to those of ordinary skill in the art.

Figure 3:
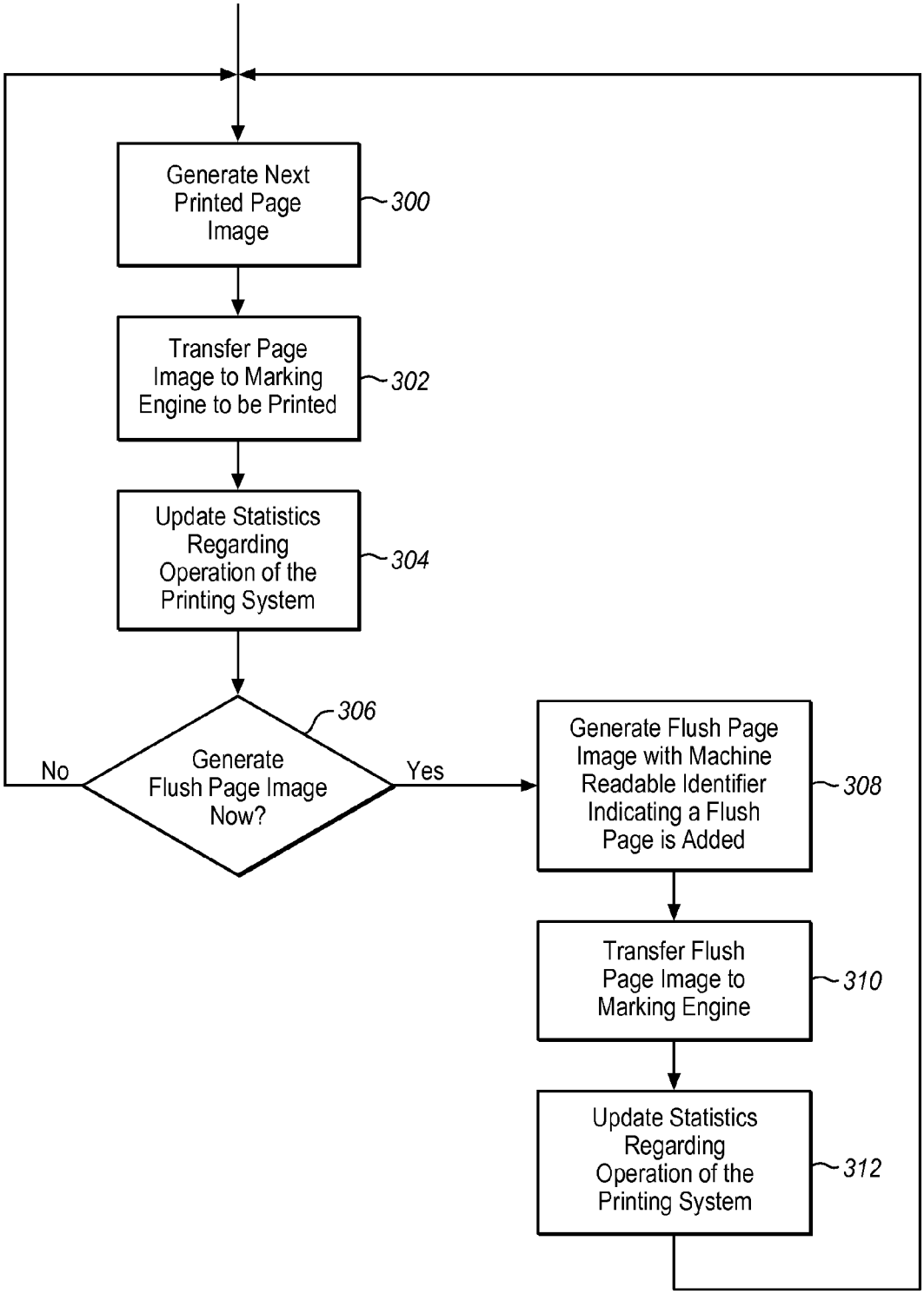
FIG. 3 is a flowchart describing an exemplary method to generate flush pages interspersed/inserted with other printed pages in accordance with features and aspects hereof.

FIG. 3 is a flowchart providing exemplary additional details of a method in accordance with features and aspects hereof. FIG. 3 generally represents processing by a printer controller associated with a flush page generation element and adapted to generate printed page images for transfer to a marking engine. Step 300 is operable to generate a next printed page image representing one printed page in a sequence of such printed pages representing a received print job. Step 300 therefore renders printer commands and data to generate a next printed page image (e.g., a sheetside image). Step 302 then transfers the generated page image to the text marking engine so that the rendered page may be imprinted on a suitable printable medium (e.g., paper-cut sheet or continuous form). Step 304 then updates statistics regarding operation of the printing system. As noted above, such statistics may include total pixel counters, pixel counters for each color of ink, page counters, etc. Based on such updated statistics, step 306 determines whether a flush page should be generated now. For example, if the pixel and/or page counters suggest that a flush is appropriate for one or more ink colors of the printer, an appropriate flush page with appropriate flush lines may be generated. If not, processing continues looping back to step 300 to continue printing a sequence of printed pages representing one or more print jobs and updating statistics of the printing system.

When step 306 determines that a flush page should be inserted or interspersed now with the sequence of pages presently being printed, step 308 generates a flush page image to be imprinted and inserted or interspersed with the present sequence of printed pages. The generated flush page image preferably includes a machine readable identifier or indicia indicating that the page image represents an added, inserted, flush page rather than a page associated with the sequence of printed pages for one or more print jobs. In addition, as noted above, the machine readable identifier may include encoded information useful for an operator of the printing system. The encoded information may include, for example, selected information from the gathered statistics regarding operation of the printing system as well as at the other statistics relating to the volume of ink flushed by the generation of Step 310 then transfers the generated flush page image to the marking engine for imprinting on printable media. Step 312 may then further update the gathered statistics to reflect the current operating status of the printing system following printing of the flush page image. Processing then continues looping back to a step 300 to continue generating printed pages of the sequence of printed pages representing one or more print jobs.

Figure 4:
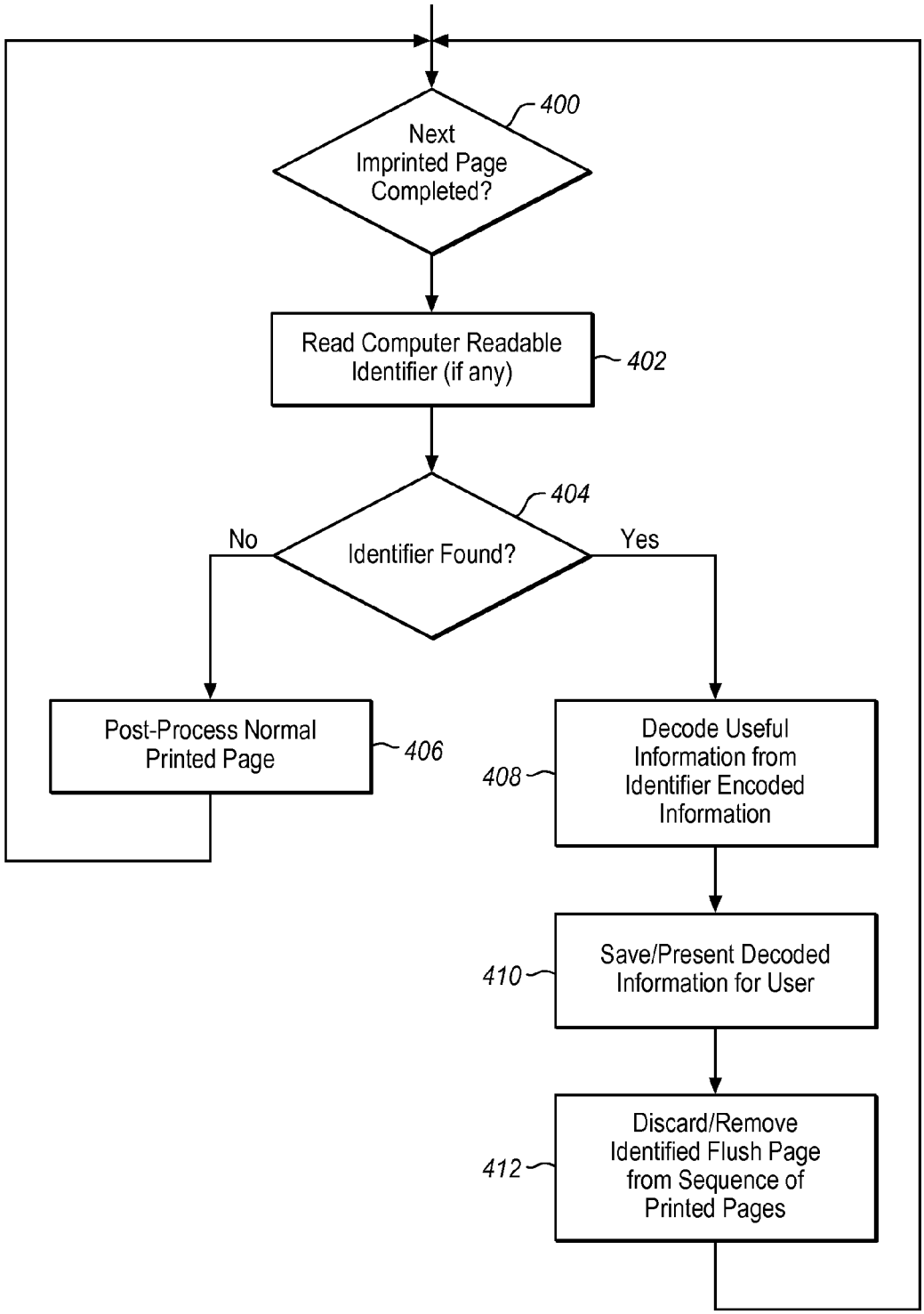
FIG. 4 is a flowchart describing an exemplary method to remove interspersed flush pages from the sequence of printed pages in accordance with features and aspects hereof.

As noted above, a flush page extractor device, typically associated with post-processing devices that physically receive the imprinted images from the marking engine), identifies and then extracts the added, inserted, flush pages from the sequence of printed pages representing one or more print jobs. FIG. 4 is a flowchart describing an exemplary method in accordance with features and aspects hereof for operation of such an extractor element. Step 400 is first operable to sense when a next imprinted page is completed by operation of the marking engine. For example, any suitable mechanical or optical sensor may detect a page exiting the marking engine. When a next imprinted page is available, step 402 attempts to read the computer-readable identifier (if any) imprinted on the just completed a printed page. As noted above, the computer readable identifier, if present, may be any unique symbol that identifies the imprinted page as an added, inserted, flush page as distinct from any of the printed pages in the sequence of printed pages representing one or more print jobs. In particular, for example, the computer-readable identifier may be a bar code sequence encoding information such as gathered statistical information regarding the operating printing system or other statistical information relating to the flush performed by the added, inserted flush page. Step 404 determines whether any identifier was found. If not, step 406 performs normal post-processing of the printed page as one of the sequence of printed pages representing one or more print jobs. Such normal post-processing may entail, for example, cutting, stacking, folding, inserting, binding, etc. Processing continues looping back to step 400 to await completion of the next imprinted page from the marking engine.

If step 404 senses a computer-readable identifier on the just completed imprinted page, step 408 decodes any useful information from the identifier containing such encoded information. As noted above, the computer readable identifier may include bar coded or other encoded information in addition to simply identifying the flush page as such. Any decoded information may be extracted by the post-processing page extractor element and may be presented to a user/operator of the printing system. For example, such presentation may include simply diverting the flush page into a separate output bin/tray for later review by an operator. Alternatively, for example, presentation of the encoded information may entail reading and converting the computer readable, encoded information and storing such information in a memory for later recall and presentation to an operator/user. Step 410 therefore represents such processing to save or in any way present the decoded information to an operator/user of the printing system. Lastly, step 412 physically removes the identified flush page from the sequence of otherwise normal printed pages representing one or more print jobs. As noted, discarding or removing the flush page may simply entail diverting the flush page to a separate output bin/tray associated with post-processing elements coupled to the marking engine. In all cases, processing continues looping back to step 400 to await completion of the next imprinted page.

Figure 5:
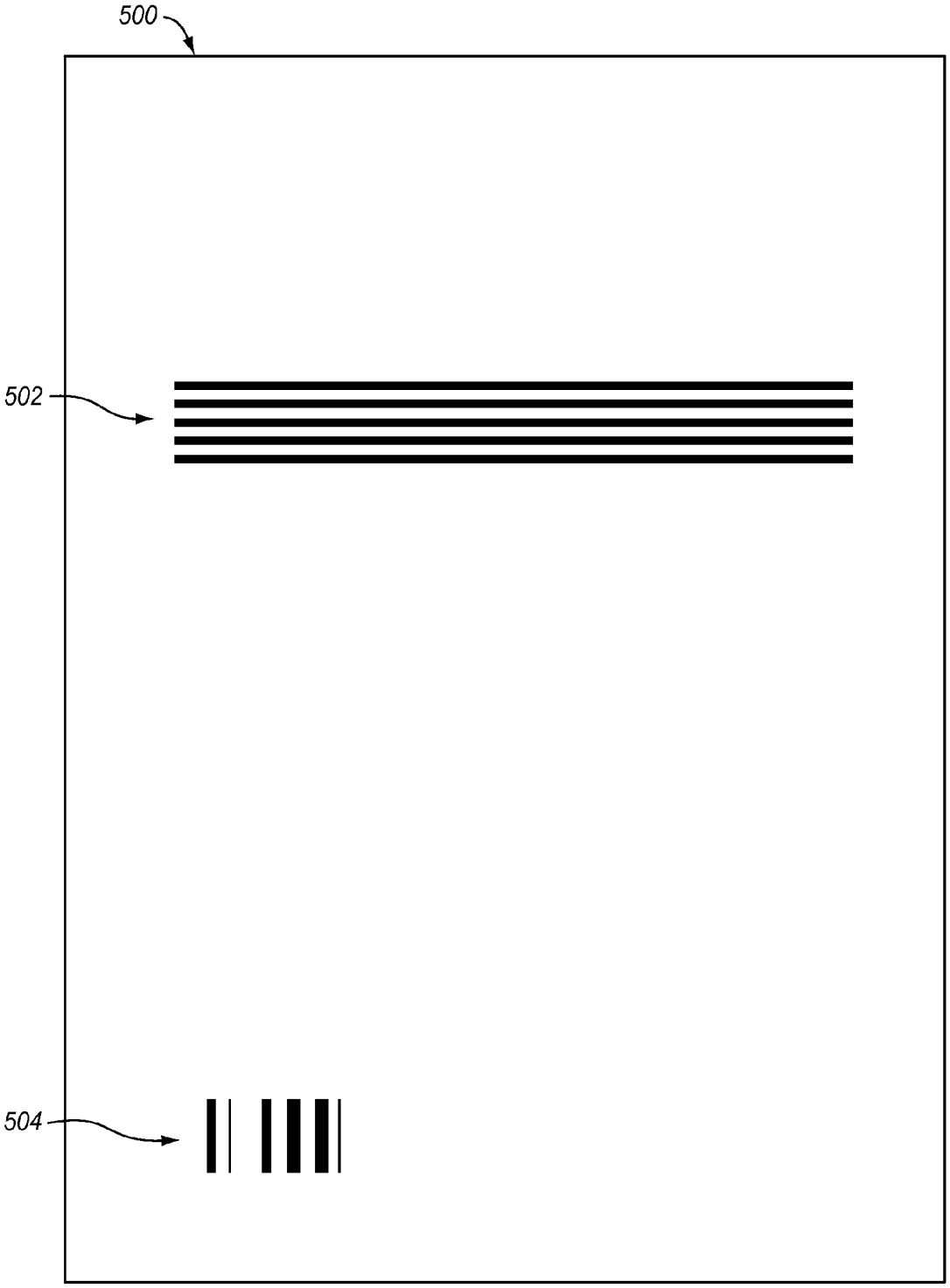
FIG. 5 is diagram describing an exemplary flush page in accordance with features and aspects hereof.

FIG. 5 is an exemplary flush page image 500 including flush lines 502 to flush selected ink nozzles of the marking engine and having a suitable identifier 504 to uniquely identify the flush page as such as distinct from a normal printed page that forms part of a print job. Those of ordinary skill in the art will readily recognize that the flush lines 502 may be any suitable pattern to generate flushing of one or more selected nozzles comprising one or more ink colors in the printing system. Further, as noted above, identifier 504 is preferably a machine readable symbol so that an extractor element may detect the identifier and thus identify the flush uniquely as such as distinct from a printed page of a job. Further, as noted above, the machine readable identifier may be a bar coded sequence containing information about the flush page image and/or about the printing system.

Figure 6:
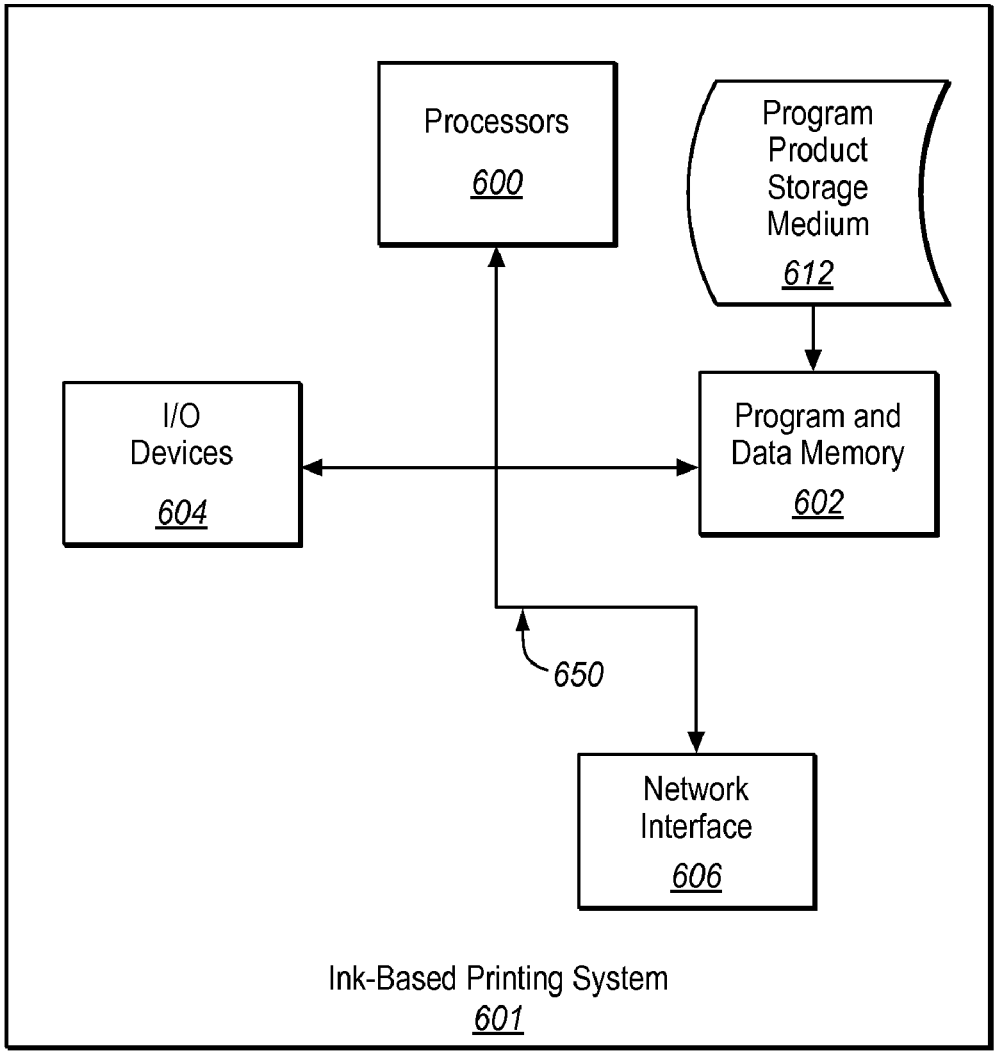
FIG. 6 is a block diagram of a system adapted to read computer readable media embodying methods hereof.

Embodiments of the invention can take the form of an entirely hardware embodiment, an entirely software embodiment or an embodiment containing both hardware and software elements. In a preferred embodiment, the invention is implemented in software, which includes but is not limited to firmware, resident software, microcode, etc. FIG. 6 is a block diagram depicting an ink-based printing system 901 as a system adapted to provide features and aspects hereof by executing programmed instructions and accessing data stored on a computer readable storage medium 612.

Furthermore, the invention can take the form of a computer program product accessible from a computer-usable or computer-readable medium 612 providing program code for use by or in connection with a computer or any instruction execution system. For the purposes of this description, a computer-usable or computer readable medium can be any apparatus that can contain, store, communicate, propagate, or transport the program for use by or in connection with the instruction execution system, apparatus, or device.

The medium can be an electronic, magnetic, optical, electromagnetic, infrared, or semiconductor system (or apparatus or device) or a propagation medium. Examples of a computer-readable medium include a semiconductor or solid state memory, magnetic tape, a removable computer diskette, a random access memory (RAM), a read-only memory (ROM), a rigid magnetic disk and an optical disk. Current examples of optical disks include compact disk—read only memory (CD-ROM), compact disk—read/write (CD-R/W) and DVD.

A data processing system suitable for storing and/or executing program code will include at least one processor 600 coupled directly or indirectly to memory elements 602 through a system bus 650. As noted above, processors may be distributed among various control elements of a printing system such as in a rasterizing printer controller and a page extractor post-processing element. The memory elements can include local memory employed during actual execution of the program code, bulk storage, and cache memories which provide temporary storage of at least some program code in order to reduce the number of times code must be retrieved from bulk storage during execution.

Input/output or I/O devices 604 (including but not limited to keyboards, displays, pointing devices, etc.) can be coupled to the system either directly or through intervening I/O controllers. Network adapter interfaces 606 may also be coupled to the system to enable the data processing system to become coupled to other data processing systems or storage devices through intervening private or public networks. Modems, cable modems, IBM Channel attachments, SCSI, Fibre Channel, and Ethernet cards are just a few of the currently available types of network or host interface adapters.

Although specific embodiments were described herein, the scope of the invention is not limited to those specific embodiments. The scope of the invention is defined by the following claims and any equivalents thereof.

What is claimed is:

1. A method for managing ink flush operations in an ink-based printing environment, the method comprising:

pausing the printing of a print job by a marking engine;

printing a flush page image and a machine readable identifier onto a flush page with the marking engine;

resuming the printing of the print job with the marking engine;

processing pages printed by the marking engine to detect the flush page amongst the pages printed by the marking engine based on the machine readable identifier; and removing the flush page from the pages printed by the marking engine, responsive to the detection of the machine readable identifier.

2. The method of claim 1 further comprising:

gathering statistics regarding ink usage in the printing environment; and determining from the gathered statistics when a flush page should be inserted to flush ink through the marking engine, wherein the pausing is responsive to the determination that a flush page should be inserted.

3. The method of claim 1 wherein the printing of the flush page includes marking the flush page with a unique symbol, wherein the machine readable identifier comprises the unique symbol.

4. The method of claim 1
wherein the printing of the flush page includes marking the flush page with bar code information,
wherein the step of processing includes detecting the bar code as the machine readable identifier.

5. The method of claim 4
wherein the marking of the bar code includes marking the flush page with printer statistical information encoded in said bar code.

6. The method of claim 5
wherein the printer statistical information includes one or more of: pages printed, pixels printed, pixels printed for each ink color, pages printed since last flush page, printer system identification information, date, time, and printer system maintenance information.

7. A method operable in an inkjet printing system for flushing ink in the inkjet printing system, the method comprising:
generating a flush page image including a flush pattern to flush ink through a marking engine of the inkjet printing system;
printing the flush page image on a printable medium interspersed with a sequence of printed pages;
identifying the flush page image on the printable medium; and
removing from the sequence of pages a page of the printable medium including the flush page image.

8. The method of claim 7 further comprising:
gathering printer statistical information; and
marking the flush page image with a bar code representation of the printer statistical information,
wherein the step of identifying further comprises detecting the bar code.

9. The method of claim 8 further comprising:
presenting to a user the printer statistical information represented in the detected bar code.

10. The method of claim 8
wherein the printer statistical information includes one or more of: pages printed, pixels printed, pixels printed for each ink color, pages printed since last flush page, printer system identification information, date, time, and printer system maintenance information.

11. An ink-based printing system comprising:
a host interface for receiving a print job from an attached host system;
a controller coupled to the host interface for rendering sheetside images representing the print job;
a marking engine coupled to the controller for receiving the sheetside images and for marking a printable medium with the sheetside images to generate a sequence of printed pages;
a flush page generator coupled to the controller and coupled to the marking engine to controllably insert a flush page in the sequence of printed pages as the sequence of printed pages are imprinted by the marking engine wherein the flush page includes a flush page image to be imprinted on the flush page by the marking engine and wherein the flush page image includes pixels to effectuate a flushing of ink in the marking engine; and
a flush page extractor coupled to receive the imprinted pages from the marking engine and adapted to detect the flush page within the sequence of printed pages and to remove the flush page from the sequence of printed pages.

12. The system of claim 11
wherein the controller further comprises:
a statistics gathering element adapted to gather printer statistical information regarding the printing system for presentation to a user.

13. The system of claim 12
wherein the printer statistical information includes one or more of: pages printed, pixels printed, pixels printed for each ink color, pages printed since last flush page, printer system identification information, date, time, and printer system maintenance information.

14. The system of claim 12
wherein the flush page generator further comprises:
a bar code generator coupled to the statistics gathering element to encode the printer statistical information as bar coded information included in the flush page image,
wherein the flush page extractor further comprises:
a bar code reader to read the printer statistical information from a page.

15. The system of claim 12
wherein the flush page generator is responsive to the printer statistical information to determine when to insert the flush page into the sequence of printed pages.

16. A computer readable medium tangibly embodying programmed instruction which, when executed by a computer, perform a method for managing ink flush operations in an ink-based printing environment, the method comprising:
pausing the printing of a print job by a marking engine;
printing a flush page image and a machine readable identifier onto a flush page with the marking engine;
resuming the printing of the print job with the marking engine;
processing pages printed by the marking engine to detect the flush page amongst the pages printed by the marking engine based on the machine readable identifier; and
removing the flush page from the pages printed by the marking engine, responsive to the detection of the machine readable identifier.

17. The computer readable medium of claim 16 wherein the method further comprises:
gathering statistics regarding ink usage in the printing environment; and
determining from the gathered statistics when a flush page should be inserted to flush ink through the marking engine,
wherein the pausing is responsive to the determination that a flush page should be inserted.

18. The computer readable medium of claim 16
wherein the printing of the flush page includes marking the flush page with a unique symbol,
wherein the machine readable identifier comprises the unique symbol.

19. The computer readable medium of claim 16
wherein the printing of the flush page includes marking the flush page with bar code information,
wherein the step of processing includes detecting the bar code as the machine readable identifier.

20. The computer readable medium of claim 19
wherein the marking of the bar code includes marking the flush page with printer statistical information encoded in said bar code.

21. The computer readable medium of claim 20
wherein the printer statistical information includes one or more of: pages printed, pixels printed, pixels printed for each ink color, pages printed since last flush page, printer system identification information, date, time, and printer system maintenance information.

* * * * *